US005097767A

United States Patent [19]

Cirillo

[11] Patent Number: 5,097,767

[45] Date of Patent: Mar. 24, 1992

[54] CARTRIDGE GUIDE NOSE

[76] Inventor: James Cirillo, 359 Knox Dr., Brunswick, Ga. 31520

[21] Appl. No.: 601,664

[22] Filed: Oct. 22, 1990

[51] Int. Cl.[5] ..... F42B 14/00

[52] U.S. Cl. ..... 102/506; 102/517

[58] Field of Search ..... 102/517, 519, 507, 508, 102/509, 510, 506

[56] References Cited

U.S. PATENT DOCUMENTS

| | | | |
|---|---|---|---|
| 4,814 | 3/1872 | Maduell | 102/506 |
| 122,620 | 1/1872 | Maduell | 102/506 |
| 216,974 | 7/1879 | Rice | 102/506 |
| 221,249 | 11/1979 | Nowlan | 102/506 |
| 926,431 | 6/1909 | Luger | 102/517 |
| 1,746,397 | 11/1930 | Johnson | 102/439 |
| 3,186,342 | 1/1965 | Hancock | 102/522 |
| 4,175,492 | 11/1979 | Knappworst et al. | 102/517 |
| 4,624,187 | 11/1986 | Bocker | 102/517 |
| 4,644,866 | 2/1987 | Sullivan | 102/439 |
| 4,829,906 | 5/1989 | Kaswer | 102/514 |

*Primary Examiner*—Michael J. Carone

*Attorney, Agent, or Firm*—Collard, Roe & Calgano

[57] ABSTRACT

The invention relates to a guide nose on a bullet to enable the user to fire wad cutter type ammunition. The guide nose allows the bullet to be used in new automatic weapons and can be easily chambered into the barrel. When the bullet is fired, the plastic nose which is constructed in two pieces separates due to the spinning force of the bullet without effecting the direction of the flat bullet, which continues towards its target. The plastic guide nose will be secured to the bullet nose flat surface. In a preferred embodiment, the two halves snap into each other with a plastic snap joint to further keep the pieces together until the bullet is fired.

9 Claims, 3 Drawing Sheets

CARTRIDGE GUIDE NOSE

BACKGROUND OF THE INVENTION

1. Field of the Invention

The invention relates to a guide nose on a bullet to enable the user to fire "wad cutter" or sharp cornered non-tapered profile type ammunition. The guide nose allows the bullet to be used in new automatic weapons and can be easily chambered into the barrel.

2. The Prior Art

It is known to provide an ammunition round with special features, such as the sabot shown in the Sullivan U.S. Pat. No. 4,644,866 or in the Bocker U.S. Pat. No. 4,624,187.

The Johnson U.S. Pat. No. 1,746,397 discloses a bullet guide which receives a tapered bullet in the cartridge. The bullet guide which may be constructed of any soft material such as compressed paper, fibre or wood, falls away from the bullet as soon as the shell is fired out of the barrel.

The Hancock U.S. Pat. No. 3,186,342 discloses a simple two-stage bullet which enables the user to convert a large bore gun to use smaller caliber ammunition such as .22 caliber. The adapter piece which is mounted behind the bullet falls away after the bullet is fired.

The Knappworst U.S. Pat. No. 4,175,492 relates to a tapered bullet or projectile which has a cap in an opening or cavity that blows off the projectile after it has been fired. Presumably, gases which enter into the opening will blow the cap off after it has been fired. There is no discussion that the nose can separate into two pieces or that it spins off by centrifugal force. It is possible that the nose which fits into the projectile as shown in FIG. 1*b* would probably stay with the projectile during its entire flight, unless the gases of the gun push it out. The present invention is an improvement over Knappworst, in that the pieces separate due to the spinning of the bullet, and do not disturb its trajectory as the bullet travels.

In addition, Knappworst shows the use of this cap for covering the cavity of a bullet for helping to chamber the bullet to automatic weapons. The cap may not necessarily be ejected from the bullet or disintegrate after the bullet is fired and before the bullet reaches its target. However, this patent requires that the bullet contain a channel back to the powder so that the pressure of the gases will force or burn the cap off after it is fired.

In Knappworst, the projectile still retains the ogive, or taper, and the cap in Knappworst just allows a large hollow point. Some hollow point cartridges without a nose cap can still function, such as speer 200 GR 45 acp hollow point. In no way does Knappworst teach a full diameter hollow nose bullet, whereas the guide nose of the present invention does.

Also the Knappworst cap is in the way of bullet travel down the barrel after ignition and can, or may, obstruct the bullet travel path.

SUMMARY OF THE INVENTION

The present invention relates to a guide nose on a bullet to enable the user to fire "wad cutter" or non-tapered full bore nose type ammunition. The term wad cutter refers to a blunt or flat nose full diameter bullet. The guide nose allows the bullet to be used in new automatic weapons and can be easily chambered into the barrel. When the bullet is fired, the plastic nose which is constructed in two pieces, separates due to the centrifugal spinning force of the bullet without effecting the direction of the flat bullet, which continues towards its target. The plastic guide nose will be secured to the bullet nose flat surface. In a preferred embodiment, the two halves snap into each other with a plastic snap joint to further keep the pieces together until the bullet is fired.

The guide nose allows the bullet to travel through the firearm action permitting the softest or most blunt full diameter bullet to be used. It allows any complex design or configuration or construction for the bullet. The guide nose allows frangible nose bullets to feed in firearms for use in limited penetration areas. By contrary, the Knappworst patent must use a hard tapered bullet surrounding the cap. The guide nose allows the use of frangible constructions for the entire bullet, allowing a projectile to have limited penetration for safely stopping within an intended target. Without the guide nose, this type of bullet would disrupt the pistol action, causing a malfunction.

The cap sits on a flat surface of the wad-cutter bullet and it spins off into two pieces. Moreover, the cap snaps together with plastic fingers and could be temporarily cemented and affixed to the nose of the wad-cutter bullet.

The guide nose allows a blunt flat sharp rim full bore diameter projectile to feed through the mechanical action of a full or semiautomatic pistol or sub-machine gun. Once fired, the projectile proceeds normally down the gun barrel. Then when the projectile starts to protrude out of the gun bore, the two halves of the guide nose pull apart due to the centrifugal force imparted by the spinning bullet. This causes the projectile to proceed accurately out from the pistol bore without restriction.

Allowing the use of a full flat nose or blunt nose sharp rim perimeter projectile increases the stopping power of the bullet when used against animals as tissue is destroyed through the bullet travel causing a permanent wound channel. It was established by forensic experts as the most contributing factor of stopping power. An additional benefit of a sharp rim perimeter flat nose bullet is its ability to penetrate a surface, even if it strikes the surface with extreme obliquity to this surface.

Previously before this invention, flat full sharp rim diameter bullets were not used, because of the malfunction they cause due to the inability to clear through the action of automatic pistols. They also are not used in revolvers even though they will function due to the difficulty of loading the revolver chambers with full flat sharp rim diameter cartridges. With the use of the guide nose, revolvers can be loaded readily as the pointed convex guide nose will center in the chamber even if the cartridge was introduced off center.

The guide nose is not a sabot. A sabot fully encloses a smaller projectile. The guide nose only guides the cartridge nose thus directing the cartridge into the center of the chamber for firing.

In one particular embodiment of the guide nose, a portion of the projectile remains above the case allowing the use of a heavier bullet. It does not need the bullet to be seated below the cartridge case mouth in order to crimp and secure the guide nose, as in other embodiments. This guide nose still splits in two and is snapped together as in other embodiments.

In some embodiments of the guide nose, the bullet is seated just below cartridge case rim in order to secure the guide nose by the crimp of the case mouth. This limits the bullet weight, because too heavy a bullet will project too deeply into the case causing excessively high pressure during ignition. In a preferred embodiment, the guide nose permits the bullet to project above the case mouth rim, because the guide nose has tail segments which fit into grooves in the bullet outer periphery. This plastic guide nose allows the cartridge case to ride lower on the bullet and still secure the guide nose to the bullet. This provides increased powder space or larger heavy bullet projecting above case rim. The guide nose allows for the bullet to project above the case rim. The guide nose is still split in half but has projections located along the side grooves in a matching bullet, allowing the case to secure the guide nose to the bullet by compression of guide nose tail segments.

The advantages of the guide nose bullet of the invention are as follows. Whereas the Knappworst prior art bullet has a hollowed out conventional nose, the guide nose of the bullet of the invention permits the use of a full diameter bullet having a sharp edge around the perimeter of an otherwise flat headed bullet. On many surfaces such as an autobody, metal, wood, or trees the ogive head of the Knappworst bullet when fired oblique can cause the bullet to ricochet, whereas the sharp edge of the bullet of the invention will cut into and then be pulled into the target, at the point of penetration. In the Knappworst patent, the guide plug can be off center and thus shift the center of gravity of the bullet in flight, since once it is airborne it will cause the bullet to wobble while the projectile is accelerating. This can cause deflection or inaccuracy of the projectile flight path or it may even be struck while still in the bore flight causing bullet and/or bore deformation.

In the prior art bullet, the cap cover is in front of the bullet within the barrel and in front of the projectile body. Once the discharged gas of the bullet can flow around the head cap of the bullet, the gas will slow down below projectile speed (no pressure behind it). Another disadvantage is that as the gas pushes out the plug, the bullet flight is reduced, because of the gas flowing through the bullet. The prior art bullet has the further disadvantage that as bullet flight velocity is reduced due to gas leakage, so is the kinetic impact energy and also is the degree of penetration. The guide nose of the invention never obstructs the bullet in flight. In fact it helps stabilize the bullet by supporting the bullet nose through the bore travel, while acting as a bore scrubber. Also the bullet of the invention seals the bore.

It is an object of the present invention to provide an ammunition round which overcomes all of the aforementioned disadvantages.

It is another object of the present invention to provide an ammunition round which is capable of functioning in all types of firearms including automatic weapons, in which a bullet nose guide is separated from the bullet into fragments after ejection from the barrel of the firearm in front of the bullet.

The above objects are accomplished in accordance with the present invention by providing an ammunition round comprising a cartridge case having a closed end and an open end with a circumferential wall connecting the closed end to the open end for containing an explosive charge. A solid bullet having a rear end and a front end, the rear end fitting into and sealing the open end of the cartridge case to provide an enclosure for the charge within the case, and the front end being a flat central surface with a sharp pointed edge perimeter surrounding and elevated above the flat central surface and the perimeter adjacent to the circumferential wall. A solid guide nose for the bullet comprising two solid halves releasably joined together, the guide nose having a bottom end and a top end, the bottom end of the guide nose corresponding to the front end of the bullet for mating engagement therewith, and the top end of the guide nose being a curvilinearly rounded smooth continuous surface. Therefore the rotational propulsional movement of the bullet and guide nose combination through the rifling of a barrel of a gun imparts centrifugal forces to the combination that are counterbalanced as long as the combination remains within the barrel of the gun, but whenever the combination exits the barrel, the centrifugal forces cause the guide nose to split apart into its two halves and remain separated from each other and from the bullet.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF PREFERRED EMBODIMENTS

Figure 1:
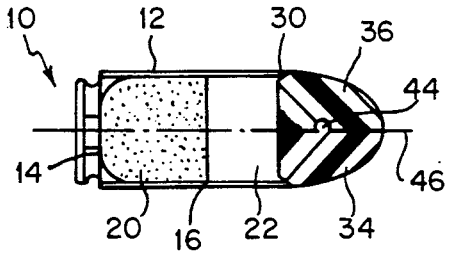
FIG. 1 shows a section view along the length of an ammunition round according to the present invention.

Turning now in detail to the drawings, FIG. 1 shows an ammunition round 10 comprising hollow cartridge case 12 having a closed end 14 and an open end 16 with circumferential wall 18 connecting the closed end to the open end for containing an explosive charge 20 there within. A solid bullet 22 having a rear end 24 and a front end 26, has the rear end fitting into and sealing the open end 16 of the cartridge case 12. This provides an enclosure for the charge 20 within the case 12. The front end 26 of the bullet is a flat central surface 28 with a sharp pointed edge perimeter 30 surrounding and elevated above the flat central surface. The perimeter 30 is shown in greater detail in FIG. 2 and can be seen as being adjacent to the circumferential wall 18.

A solid guide nose 32 for the bullet comprises two solid halves 34 and 36 releasably joined together. The guide nose 32 has a bottom end 38 and a top end 40. The bottom end 38 of the guide nose 32 corresponds to the front end 26 of the bullet 22 for permitting the mating engagement therewith. The top end 40 of the guide nose is a curvilinearly rounded smooth continuous surface.

Figure 8:
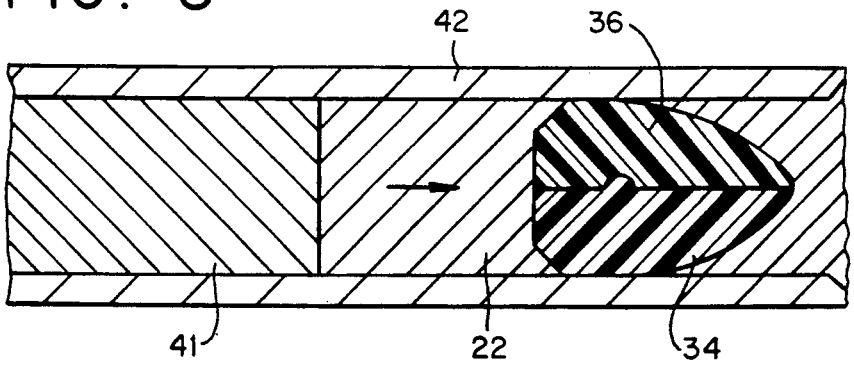
FIG. 8 shows the path of travel of a bullet plus guide nose in a gun barrel.
Figure 9:
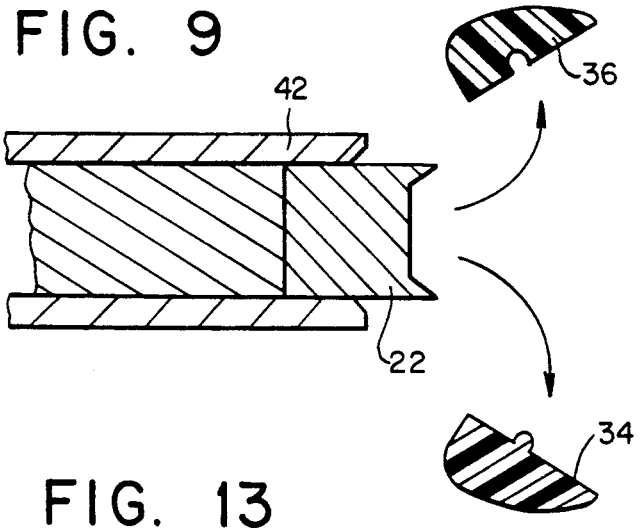
FIG. 9 shows the separation of the guide nose from the bullet as it leaves the gun barrel and the further separation into the two halves of the guide nose.
Figure 13:
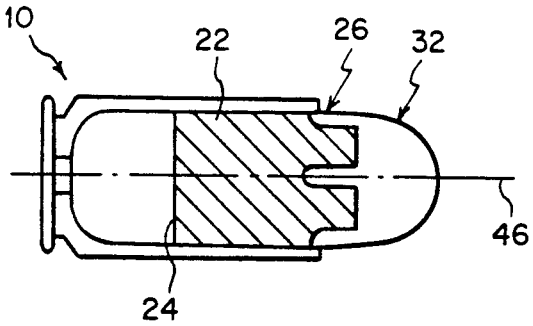
FIG. 13 shows a section view along the length of an ammunition round having the guide nose of FIG. 10 and the bullet of FIG. 11.

The rifling 41 within the barrel 42 of a gun as shown in FIGS. 8 and 9 causes rotational movement of the bullet, and along with propulsional movement of the bullet 22, and the guide nose 32, as a combination through the barrel of the gun, imparts centrifugal forces to the combination. These centrifugal forces are counterbalanced as long as the combination remains within the barrel 42 of the gun, as shown in FIG. 8. Whenever the combination exits the gun barrel, as shown in FIG. 9, the centrifugal forces, now no longer counterbalanced, caused the guide nose 32 to split apart into its two halves 34 and 36 and to remain separated from each other and from the bullet 22. Thus, the bullet is fully stabilized while it is traversing the rifling and moves unobstructedly through the gun. The guide nose is constructed of a rubber or plastic material, and preferably is polyethylene. This polyethylene riding on the rifling actually cleans the bore of the gun from lead or copper deposits within the gun barrel.

Figure 4:
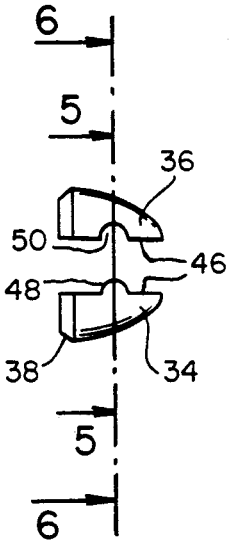
FIG. 4 shows the guide nose separated apart into two halves.

There is an attachment means 44 for releasably joining together the two halves of the bullet guide nose. The ammunition round 10 has a longitudinal axis 46, and the guide nose 32 has the same longitudinal axis 46 connecting the top end 40 to the bottom end 38. The longitudinal axis 46 is a dividing line for the separating apart of the two halves 34 and 36 of the bullet guide nose 32. As shown in FIG. 4, one of the two halves 34 of the bullet guide nose has an attachment means comprising a shaped protuberance 48 located along the longitudinal axis 46. The other of the two halves 36 of the bullet guide nose has a corresponding attachment means comprising a channel 50 corresponding in shape to the protuberance in order to releasably receive and grip the protuberance 48. The channel 50 is located along the longitudinal axis 46.

Figure 2:
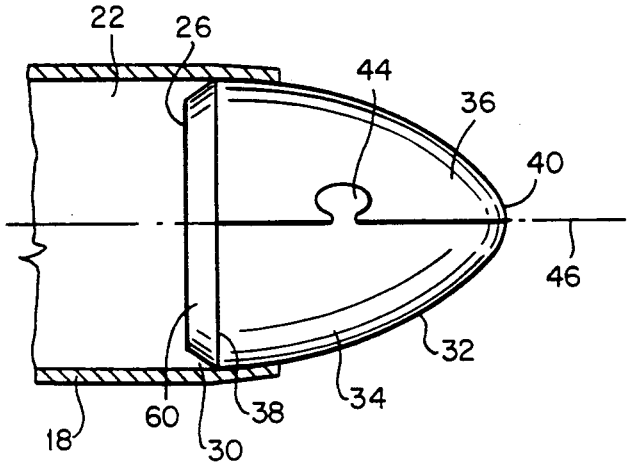
FIG. 2 shows a section view of the upper portion of the ammunition round of FIG. 1.

The circumferential wall 18 of the cartridge case completely encloses the rear end 24 of the bullet 22, as shown in FIG. 2. The circumferential wall also completely encloses the front end 26 of the bullet and encloses the bottom end 38 of the guide nose 32.

Figure 5:
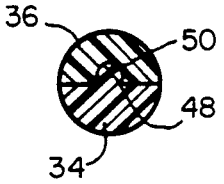
FIG. 5 shows a section view of one embodiment of the guide nose along line 5—5 of FIG. 4.

In one embodiment, the shaped protuberance 48 comprises one rounded detent, as shown in FIG. 5. The channel 50 comprises a rounded shaped groove corresponding to the rounded detent 48.

Figure 6:
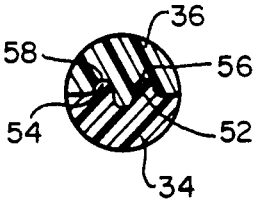
FIG. 6 shows a section view of another embodiment of the guide nose along line 6—6 of FIG. 4.

In further embodiment according to the present invention, the shaped protuberance 48 comprises at least two rounded detents 52 and 54, as shown in FIG. 6. The channel 50 comprises at least two rounded shaped grooves 56 and 58 corresponding to the rounded detents, as shown in FIG. 6.

The ammunition round may also include an adhesive means 60, as shown in FIG. 2, for releasably cementing the bottom end 38 of the guide nose 32 to the front end 26 of the bullet 22.

Figure 7:
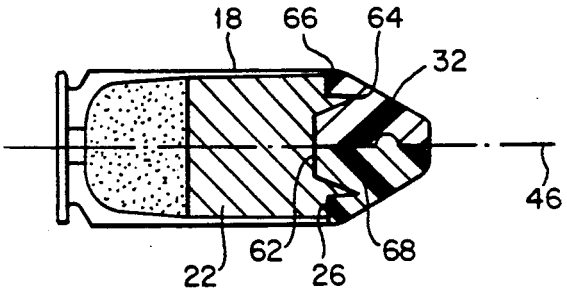
FIG. 7 shows a section view along the length of a further embodiment of an ammunition round according to the present invention.
Figure 14:
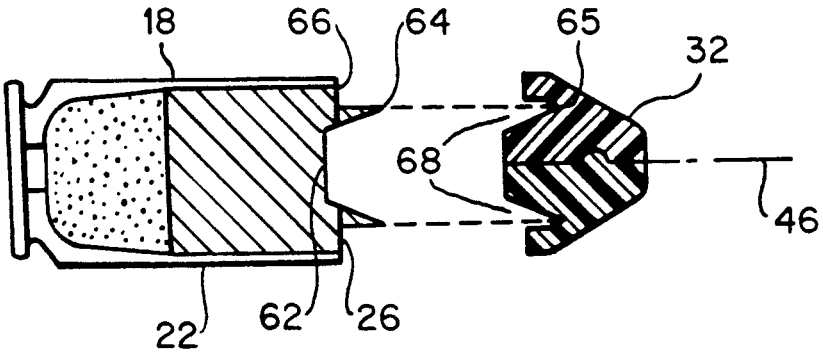
FIG. 14 shows an exploded section view of the embodiment of FIG. 7.

In a further embodiment, the outer front end 26 of the bullet 22 includes a flat outer perimeter surface 66, as shown in FIGS. 7 and 14, with a sharp pointed inner perimeter 64 surrounding and elevated above the flat central surface 62. The inner perimeter 64 is located inwardly a spaced distance from the circumferential wall 18 and this inwardly spaced distance is the flat surface 66. The bottom end 68 of the guide nose is concave shaped at location 65, as shown in FIGS. 7 and 14, for corresponding to inner perimeter 64 at the front end 26 of the bullet 22.

Figure 3:
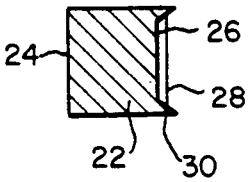
FIG. 3 shows the wad-cutter bullet of the invention after the guide nose has fallen off.

In the embodiment as shown in FIGS. 1, 2 and 3, the bottom end 38 of the guide nose 32 is convex shaped for corresponding to the concave shaped front end 28 of the bullet 22, in order to provide a mating engagement therewith.

Figure 11:
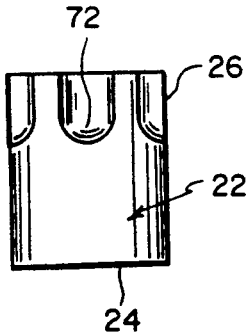
FIG. 11 shows a side view of a bullet for the nose guide of FIG. 10.
Figure 12:
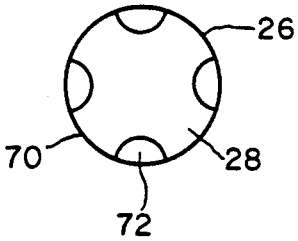
FIG. 12 shows a top view of the bullet of FIG. 11.

FIGS. 10–13 illustrate a further embodiment of the present invention. In this embodiment, the solid bullet 22 has rear end 24 and front end 26, with the rear end fitting into and sealing the open end of the hollow cartridge case to provide an enclosure for the charge within the case. The front end 26 has a flat central surface 28 as shown in FIG. 12 with an edge perimeter 70 surrounding the flat central surface 28. This perimeter 70 is adjacent to the circumferential wall of the cartridge. This perimeter has a number of longitudinal grooves 72 as shown in FIG. 11, that begin at the front end 26 of the bullet and extend toward the rear end 24 of the bullet. The longitudinal grooves are parallel to each other and parallel to the longitudinal axis 46 of the ammunition round.

Figure 10:
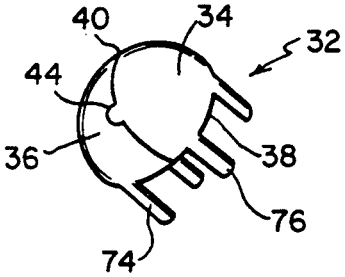
FIG. 10 shows a perspective view of another embodiment of the guide nose according to the invention.

The solid guide nose 32 for the bullet includes two solid halves 34 and 36 releasably joined together by means 44. The guide nose has a bottom end 38 and a top end 40. There is also an outer periphery 74 at the bottom end 38 of the guide nose, as shown in FIG. 10. The bottom end of the guide nose corresponds to the front end of the bullet for the mating engagement therewith. The bottom end 38 of the guide nose has a number of tail segments 76, with this number of tail segments equal to the number of longitudinal grooves 72 in the bullet. Each tail segment 76 is parallel to every other tail segment and is parallel to the longitudinal axis 46, and is equal in length, width and thickness to the longitudinal groove 72 of the bullet for the mating engagement therewith. The tail segments 76 are positioned along the outer periphery 74 of the bottom end 38 of the guide nose 32.

The present invention will now be further disclosed by reference to the following example, which is supplied solely for the purpose of illustration and is not intended as defining the limits and scope of the present invention.

EXAMPLE 300 of the guide nose bullets were fired from a variety of weapons, both handguns and rifles, automatic and semi-automatic varieties. The bullets penetrated a full size Chrysler heavy door. The angle of fire was less than 30°. The bullets were all lead bullets. Some bullets had a heavy copper jacket. At a firing range, the paper target had full diameter punches that were characterized by a neat and clean penetration of the target by each bullet. The plastic guide pieces broke away from the bullet and did not interfere with the trajectory of the bullet. Some bullets were also tested for soundness of construction by being dropped to the floor from a height of 6 feet. The bullet nose guides never separated from the ammunition round upon impact with the floor.

While only a few embodiments of the present invention have been shown and described, it is to be understood that many changes and modifications may be made thereunto without departing from the spirit and scope of the invention as defined in the appended claims.

What is claimed is:

1. An ammunition round comprising:

a cartridge case having a closed end and an open end with a circumferential wall connecting said closed end to said open end for containing an explosive charge;

a solid bullet having a rear end and a front end, said rear end fitting into and sealing the open end of said cartridge case to provide an enclosure for said charge within said case, and said front end being a flat central surface with a sharp pointed edge perimeter surrounding and elevated above said flat central surface and said perimeter adjacent to said circumferential wall;

a solid guide nose for said bullet comprising two solid halves releasably joined together, said guide nose having a bottom end and a top end, said bottom end of said guide nose corresponding to the front end of said bullet for mating engagement therewith, and said top end of said guide nose being a curvilinearly rounded smooth continuous surface;

wherein said guide nose has a longitudinal axis connecting said top end to said bottom end, said longitudinal axis being a dividing line for the separating apart of said two halves, of said bullet guide nose, one of said two halves of said bullet guide nose having an attachment means for releasably joining together the two halves of said bullet guide nose;

said attachment means comprising a shaped protuberance located along said longitudinal axis, and the other of said two halves of said bullet guide nose having a corresponding attachment means comprising a channel corresponding in shape to releasably receive and grip said protuberance, said channel located along said longitudinal axis; and whereby rotational propulsional movement of the bullet and guide nose combination through a barrel of a gun imparts centrifugal forces to the combination that are counterbalanced as long at the combination remains with the barrel of the gun, but whenever the combination exits the barrel, the centrifugal forces cause the guide nose to split apart into its two halves and remain separated from each other and from the bullet.

2. The ammunition round of claim 1, wherein the circumferential wall of said cartridge case completely encloses the rear end of said bullet and the front end of said bullet and encloses the bottom end of said guide nose.

3. The ammunition round of claim 1, wherein said shaped protuberance comprises one rounded detent; and wherein said channel comprises a shaped groove corresponding to said rounded detent.

4. The ammunition round of claim 1 wherein said shaped protuberance comprises at least two rounded detents; and wherein said channel comprises at least two shaped grooves corresponding to said rounded detents.

5. The ammunition round of claim 1, further comprising adhesive means for releasably cementing said bottom end of said guide nose to said front end of said bullet.

6. The ammunition round of claim 1, wherein the bottom end of said guide is convex shaped for corresponding to the concave shape front end of said bullet.

7. The ammunition round of claim 1, wherein said round has a longitudinal axis;

wherein said perimeter has a number of longitudinal grooves that begin at said front end and extend toward said rear end; said longitudinal grooves being parallel to said longitudinal axis; and wherein said guide nose has an outer periphery at the bottom end, said bottom end of said guide nose having a number of tail segments, with said number equal to the number of longitudinal grooves; each tail segment being parallel to said longitudinal axis and equal in length, width and thickness to said longitudinal groove for the mating engagement therewith; and said tail segments being positioned along said outer periphery of said bottom end.

8. An ammunition round comprising:

a cartridge case having a closed end and an open end with a circumferential wall connecting said closed end to said open end for containing an explosive charge;

a solid bullet having a rear end and a front end, said rear end fitting into and sealing the open end of said cartridge case to provide an enclosure for said charge within said case, and said front end of said bullet comprising a flat central surface, with a sharp pointed edge perimeter surrounding and elevated above said flat central surface, and said perimeter located inwardly a spaced distance from said circumferential wall, and said inwardly spaced distance being a flat surface;

a solid guide nose for said bullet comprising two solid halves releasably joined together, said guide nose having a bottom end and a top end, said bottom end of said guide nose corresponding to the front end of said bullet for mating engagement therewith, and said top end of said guide nose being a curvilinearly rounded smooth continuous surface;

whereby rotational propulsional movement of the bullet and guide nose combination through a barrel of a gun imparts centrifugal forces to the combination that are counterbalanced as long as the combination remains within the barrel of the gun, but whenever the combination exits the barrel, the centrifugal forces cause the guide nose to split apart into its two halves and remain separated from each other and from the bullet.

9. The ammunition round of claim 8, wherein the bottom end of said guide nose has a concave shaped area corresponding to the sharp pointed edge perimeter of the front end of said bullet.

* * * * *